US006092613A

United States Patent [19]

Caraway et al.

[11] Patent Number: 6,092,613

[45] Date of Patent: Jul. 25, 2000

[54] ROTARY DRILL BITS

[75] Inventors: Douglas Caraway, Kingwood, Tex.; John Hayward, Minchinhampton, United Kingdom; Malcolm R. Taylor, Gloucestershire, United Kingdom; Tom Scott Roberts, Quedgeley, United Kingdom; Steven Taylor, Cheltenham, United Kingdom; Graham R Watson, Gloucestershire, United Kingdom

[73] Assignee: Camco International (UK) Limited, Stonehouse, United Kingdom

[21] Appl. No.: 09/207,909

[22] Filed: Dec. 9, 1998

Related U.S. Application Data

[60] Division of application No. 08/835,812, Apr. 16, 1997, Pat. No. 5,904,213, which is a continuation-in-part of application No. 08/541,774, Oct. 10, 1995, Pat. No. 5,671,818.

[51] Int. Cl.[7] ..... E21B 10/60

[52] U.S. Cl. ..... 175/393

[58] Field of Search ..... 175/393, 428, 175/400, 430, 417, 399, 431

[56] References Cited

U.S. PATENT DOCUMENTS

| | | | |
|---|---|---|---|
| 3,099,324 | 7/1963 | Kucera et al. | 175/339 |
| 3,111,179 | 11/1963 | Albers et al. | 175/393 |
| 3,743,036 | 7/1973 | Feenstra et al. | 175/330 |
| 3,945,446 | 3/1976 | Ostertag et al. | 175/323 |
| 3,951,220 | 4/1976 | Phillips, Jr. et al. | 175/393 |
| 4,440,247 | 4/1984 | Sartor | 175/393 |
| 4,515,227 | 5/1985 | Cerkovnik | 175/65 |
| 4,577,706 | 3/1986 | Barr | 175/329 |
| 4,618,010 | 10/1986 | Falgout, Sr. et al. | 175/329 |
| 4,687,066 | 8/1987 | Evans | 175/340 |
| 4,718,505 | 1/1988 | Fuller | 175/329 |
| 4,733,735 | 3/1988 | Barr et al. | 175/393 |
| 4,823,892 | 4/1989 | Fuller | 175/329 |
| 4,848,491 | 7/1989 | Burridge et al. | 175/329 |
| 5,029,657 | 7/1991 | Mahar et al. | 175/393 |
| 5,145,017 | 9/1992 | Holster et al. | 175/333 |
| 5,199,511 | 4/1993 | Tibbitts et al. | 175/65 |
| 5,244,039 | 9/1993 | Newton, Jr. et al. | 175/431 |
| 5,417,296 | 5/1995 | Murdock | 175/393 |
| 5,452,628 | 9/1995 | Montgomery, Jr. et al. | 76/108.2 |
| 5,467,836 | 11/1995 | Grimes et al. | 175/401 |
| 5,671,818 | 9/1997 | Newton et al. | 175/393 |
| 5,794,725 | 8/1998 | Trujillo et al. | 175/339 |

FOREIGN PATENT DOCUMENTS

| | | | |
|---|---|---|---|
| 0 058 061 | 8/1982 | European Pat. Off. | E21B 10/26 |
| 713998 | 8/1954 | United Kingdom . | |
| 900099 | 7/1962 | United Kingdom . | |
| 2 083 102 | 3/1982 | United Kingdom | E21B 17/10 |
| 2 181 173 | 4/1987 | United Kingdom | E21B 10/60 |
| 2298666 | 9/1996 | United Kingdom | E21B 10/46 |
| WO 94/12760 | 6/1994 | WIPO | E21B 10/64 |

*Primary Examiner*—Frank Tsay
*Attorney, Agent, or Firm*—Jeffery E. Daly

[57] ABSTRACT

A rotary drill bit for use in drilling holes in subsurface formations comprises a bit body having a leading face and a gauge region, a number of blades formed on the leading face of the bit and extending outwardly away from the axis of the bit so as to define between the blades a number of fluid channels leading towards the gauge region, a number of cutting elements mounted side-by-side along each blade, and a number of nozzles in the bit body for supplying drilling fluid to the fluid channels for cleaning and cooling the cutting elements. In each of the fluid channels, adjacent the gauge region, is an opening into an enclosed passage which passes internally through the bit body to an outlet which, in use, communicates with the annulus between the drill string and the wall of the borehole being drilled. The gauge region of the drill bit comprises a substantially continuous bearing surface which extends around the whole of the gauge region.

8 Claims, 12 Drawing Sheets

ROTARY DRILL BITS

REFERENCE TO RELATED APPLICATIONS

This application is a Divisional of application Ser. No. 08/835,812 filed Apr. 16, 1997, now U.S. Pat. No. 5,904,213 which is a Continuation-in-Part of U.S. patent application Ser. No. 08/541,774, filed Oct. 10, 1995, now U.S. Pat. No. 5,671,818, the entirety of which is hereby incorporated by reference. Also, this application is related to another continuation-in-part application of the same parent application and having the same title by Alex Newton, Michael Tomczak, Steven Taylor, Andrew Murdock, and John Clegg filed simultaneously with the present application, the entirety of which is hereby incorporated by reference.

BACKGROUND OF THE INVENTION

1. Field of the Invention

The invention relates generally to rotary drill bits and, more particularly, to rotary drill bits for use in drilling holes in subsurface formations.

2. Description of the Related Art

In the normal prior art construction, the gauge region of a drill bit is formed by a plurality of kickers which are spaced apart around the outer periphery of the bit body and are formed with bearing surfaces which, in use, bear against the wall of the borehole. The kickers generally form continuations of respective blades formed on the leading face of the bit and extending outwardly away from the axis of the bit towards the gauge region so as to define between the blades fluid channels leading towards the gauge region. The spaces between the kickers define junk slots with which the channels between the blades communicate. During drilling, drilling fluid pumped down the drill string to nozzles in the bit body flows outwardly along the channels, into the junk slots at the end of the channels, and passes upwardly through the junk slots into the annulus between the drill string and the wall of the borehole.

While such PDC bits have been very successful in drilling relatively soft formations, they have been less successful in drilling harder formations, including soft formations which include harder occlusions or stringers. Although good rates of penetration are possible in harder formations, the PDC cutters may suffer accelerated wear. Thus, bit life may be too short to be commercially acceptable.

Studies have suggested that the rapid wear of PCD of bits in harder formations may be due to chipping of the cutters as a result of impact leads caused by vibration of the drill bit. One of the most harmful types of vibration can be attributed to a phenomenon called "bit whirl," in which the drill bit begins to precess around the hole in the opposite direction to the direction of rotation of the drill bit. One result of bit whirl is that some cutters may temporarily move in the reverse direction relative to the formation and this can result in damage to the cutting elements.

It is believed that the stability of such a drill bit, and its ability to resist vibration, may be enhanced by increasing the area of the bearing surfaces on the gauge region which engage the wall of the borehole. In the prior art designs, however, the area of engagement can only be increased by increasing the length and/or width of the bearing surfaces on the kickers. It may be undesirable to increase the length of the bearing surfaces since this may lead to difficulties in steering the bit in steerable drilling systems. Similarly, increasing the circumferential width of the bearing surfaces necessarily reduces the width of the junk slots between the bearing surfaces, and this may lead to less than optimum hydraulic flow of drilling fluid along the channels and over the cutters, or it may lead to blockage of the junk slots and channels by debris.

The present invention relates to a number of improvements to drill bits of this type.

SUMMARY OF THE INVENTION

In accordance with one aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of the channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, and wherein there are formed in the bearing surface a plurality of subsidiary channels to promote the flow of fluid across the surface, at least some of which subsidiary channels are in communication with the fluid channels in the leading face of the bit body and each of which subsidiary channels is of significantly smaller cross-sectional area than the channel with which it communicates, whereby the subsidiary channel receives only a minor proportion of the fluid flow along the fluid channel.

In accordance with another aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of the channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, and wherein a plurality of spaced recesses are formed in the bearing surface.

In accordance with still another aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, and wherein the bearing surface is formed with at least one aperture which communicates with said at least one enclosed passage which passes internally through the bit body.

Each aperture in the bearing surface may be in the form of an elongated slit extending generally longitudinally of the gauge section, for example generally parallel to the longitudinal axis of the drill bit.

Although the bearing surface extending around the gauge region may be in the form of a substantially continuous surface of fixed longitudinal depth and position, this is not essential, and wear of the bearing surface may be reduced by displacing portions thereof relative to one another axially of the drill bit so that, as the bit rotates, different portions of the bearing surface engage different levels of the formation forming the wall of the borehole.

Accordingly, in accordance with yet another aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, and wherein the gauge region includes portions of said bearing surface, located at different circumferential positions on the gauge, which are located at different positions axially of the drill bit.

For example, the gauge region may include portions of said bearing surface which are of smaller height, in the axial direction, than the overall height of the gauge region, adjacent portions of smaller height being displaced relative to one another in the axial direction.

In the case where said fluid channels on the leading face of the drill bit include channels which extend up to the gauge region, said smaller height portions of the bearing surface may be generally in alignment with said channels. The circumferential extent of each said smaller height portion may be substantially equal to the width, adjacent the gauge region, of the fluid channel with which it is aligned.

As previously mentioned, drill bits having a bearing surface extending around the whole of the gauge region are found to improve the steering response in a steerable drilling system. The turn rate of such a drill bit may be further improved by so shaping the bearing surface of the gauge region that it is tapered instead of being generally cylindrical.

Accordingly, in accordance with a further aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of the channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, the bearing surface tapering inwardly as it extends away from the leading face of the drill bit.

A possible disadvantage of a drill bit having a gauge bearing surface which extends around the whole of the gauge region is that it may be difficult to remove such a bit from the borehole if the borehole is not completely stable. A further concern in deviated boreholes is that the rim of the gauge region may act as a scraper on running into the hole and build up wall cake on the bit face to the extent that the bit will ball up before reaching the bottom of the borehole.

Thus, in accordance with an even further aspect of the present invention, there is provided a rotary drill bit comprising a leading pilot bit part having a leading face and a gauge region, a plurality of cutting elements mounted on the leading face of the pilot bit part, a plurality of fluid channels formed in said leading face, a plurality of nozzles mounted in the pilot bit part for supplying drilling fluid to the channels for cleaning and cooling the cutting elements, and a reaming part behind the pilot bit part which is of greater effective cutting diameter than the pilot bit part, wherein the gauge region of the pilot bit part comprises a bearing surface which extends around substantially the whole of said gauge region.

The engagement of the bearing surface of the gauge region within the pilot hole may stabilize the bit against vibration and prevent bit whirl. However, since the pilot bit part is smaller than the diameter of the final borehole, its bearing surface is spaced from the walls of the borehole when tripping in and out, so that the above-mentioned problems do not arise.

A further advantage of this arrangement is that the height of the gauge region on the pilot bit part is related to the diameter of the pilot bit part and is thus of smaller height than would be the gauge region of a drill bit of the larger diameter of the eventual borehole. Consequently, the body of the pilot bit part may be simpler to manufacture since its height may be small enough to allow the enclosed passages in the bit body to be simply drilled using conventional commercial drill bits. In larger bits, specialized equipment and techniques that are known in the art may be used to form enclosed passages in the bit body of the required length to bypass the gauge region.

The reaming part of the drill bit may be a full diameter bit part which is substantially concentric with the pilot bit part. Alternatively, however, the bit may be a bicentric bit in which the reaming part has cutting elements arranged eccentrically around only a portion of the circumference thereof. In this case, the maximum cross-sectional dimension of the reaming part may be significantly smaller than the diameter of the borehole drilled by the bit, with the result that the bit may be passed through a part of a previously formed borehole which is smaller than the effective cutting diameter of the drill bit.

In an alternative arrangement, the gauge region of the drill bit may include a bearing surface extending around a part of the circumference of the pilot bit part and a complementary bearing surface extending around part of the circumference of the reaming part, where the two bearing surfaces together extend around substantially 360 degrees of the drill bit. For example, the bearing surface on the pilot bit part may extend around substantially half the circumference of the gauge region of the pilot bit part, and the bearing surface on the reaming part may extend around the diametrically opposite half of the gauge region of the reaming part. Thus, the bearing and stabilizing effect of the bearing surface is shared between the parts of the drill bit.

In accordance with a still further aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of the channels an opening into an enclosed passage which passes internally through the bit body to an outlet which, in use, communicates with the annulus between the drill string and the wall of the borehole being drilled, the gauge region of the drill bit includes a bearing surface which extends around substantially the whole of the gauge region, and wherein the gauge region of the drill bit comprises a ring-like outer portion of the bit body which defines the outer walls of the enclosed passages passing internally through the bit body, and wherein said ring-like outer portion comprises arcuate regions of different thicknesses.

For example, in the case where at least some of said fluid channels in the leading face of the bit body extend up to the gauge region, each of said different thickness arcuate regions of the ring-like portion of the bit body may be generally in alignment with different fluid channels.

In accordance with yet a further aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, and wherein said enclosed passages extend generally helically through the bit body.

In a drill bit where the cutters are mounted on upstanding blades which extend outwardly away from the center of the bit towards the gauge region, there may be provided only a single opening in each fluid channel between adjacent blades. This may be appropriate when the bit has, for example, eight blades and the fluid channels are comparatively narrow. However, when drilling some type of formation, particularly softer formations, it may be advantageous to use a lighter set drill bit having fewer blades and cutters, since this may reduce the problem of bit balling. Such a lighter set drill bit may, for example, have only four blades, separated by fluid channels which are almost 90° in angular extent.

In such a construction, the provision of a single large opening and passage in the bit body, in order to deliver drilling fluid from each channel past the continuous gauge section to the annulus, may result in substantial structural weakening of the drill bit and, in particular, the gauge section. Accordingly, in such a drill bit, each channel may be formed with two or more openings which communicate with separate passages leading through the bit body to the annulus.

Accordingly, in accordance with another aspect of the present invention, there is provided a rotary drill bit for connection to a drill string and for drilling boreholes in subsurface formations comprising a bit body having a leading face and a gauge region, a plurality of cutting elements mounted on the leading face of the bit body, a plurality of fluid channels formed in the leading face of the bit body, and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising a bearing surface which extends around substantially the whole of the gauge region, wherein there is provided in at least one of said channels at least two circumferentially spaced openings, each of which leads into an enclosed passage passing internally through the bit body, and wherein one of said nozzles is mounted in the bit body generally between said openings.

The nozzle between the openings may be oriented to direct drilling fluid towards the gauge region of the drill bit in order to provide efficient cleaning in that region and to prevent balling in softer formations.

In accordance with still another aspect of the present invention, there is provided a method of manufacturing a drill bit. The method includes the steps of forming a bit body having spaced apart around its outer periphery a plurality of longitudinally extending slots each corresponding to the desired location of one of said enclosed passages, and mounting on the outer periphery of the bit body a peripheral ring, so that the inner surface of the ring closes off said slots to form the enclosed passages, while the outer surface of the ring provides said bearing surface of the gauge region.

The bit body may be formed with a locating formation to locate the gauge ring on the bit body. For example, the locating formation may include a circumferential step against which the gauge ring may be abutted.

The ring may be permanently affixed to the bit body, for example by welding, or may affixed thereto by detachable connecting means, such as screws or bolts. In the latter case, the ring providing the gauge bearing surface may be removed from the drill bit if required, so that the longitudinally extending slots are exposed to the formation and the bit may then operate in the same manner as a conventional bit having around its periphery open junk slots between spaced bearing surfaces. Accordingly, the bit may be converted form one type to the other depending on the nature of the formation being drilled and the estimated liability of the bit to be subject to vibration and bit whirl.

The above described method also allows the same basic bit body to be used either for the manufacture of a bit having a gauge bearing surface extending around substantially the whole of the gauge region, or the manufacture of a more conventional bit having junk slots.

An alternative method of manufacturing a drill bit of the kind referred to includes the steps of forming a bit body with a gauge region having a bearing surface which extend around substantially the whole of said gauge region, and subsequently forming said enclosed passages through the bit body at locations spaced inwardly of said bearing surface. The passages may be formed by drilling or by any other machining or forming process.

The bit body may be machined from solid metal, such as steel, or may be molded using a powder metallurgy process in which tungsten carbide powder is infiltrated with metal alloy binder in a furnace so as to form a hard matrix. The bit body may also be formed by a combination of these processes. For example, a machined steel core may have one or more bodies of matrix material, forming other parts of the bit body, applied to it by the powder metallurgy process.

In accordance with yet another aspect of the present invention, there is provided a method of manufacturing a drill bit that includes formation a bit body structure and mounting on the outer periphery of the bit body structure a peripheral ring providing the gauge region of the drill bit and comprising a bearing surface which extends around substantially the whole of the gauge region, the peripheral ring further being provided with a plurality of enclosed passages which pass internally through the ring in the general direction of the axis thereof.

Since the ring provides both some of the internal structure of the bit as well as the gauge region bearing surface, the ring may have a more substantial body of material than is the case in the previously described arrangement where the ring provides only the gauge region bearing surface. This arrangement then allows the ring to be manufactured from a material which may not be appropriate for manufacture of a thinner bearing surface ring. For example, the ring may be formed form solid infiltrated matrix material.

The bit body structure, in this case, may comprise a plurality of separate components secured together so as to embrace and secure the peripheral ring providing the gauge region bearing surface and the enclosed passages. For example, the bit body structure may comprise an upper part, providing the shank of the drill bit, a lower part, providing the leading face of the drill bit and on which the cutting elements and nozzles are mounted, and an intermediate cylindrical mandrel which is disposed between the upper and lower parts, the mandrel being surrounded by said peripheral ring which is disposed between portions of the upper and lower parts which project radially outwardly beyond the central mandrel.

Typically, the upper part and mandrel may be formed from steel, and the lower part may be formed from steel or from solid infiltrated matrix on a steel core. The mandrel may be crew-threaded and/or welded to the upper and lower parts of the bit body structure.

The problem of avoiding lack of stability, vibration and bit whirl in rotary drill bit may also apply to downhole stabilizers and particularly to near-bit stabilizers. Conventionally, a stabilizer for use in a bottom hole assembly will comprise a structure having around its outer periphery circumferentially spaced bearing surfaces which bear on the walls of the borehole, the bearing surfaces being separated by longitudinally extending outwardly open slots for the passage of drilling fluid past the stabilizer along the annulus between the drill string and the walls of the borehole.

The present invention also provides new forms of stabilizers making use of certain of the structural and functional characteristics described above as being applied to drill bits.

Thus, in accordance with a further aspect of the present invention, there is provided a stabilizer for connection to a drill string comprising a stabilizer body which includes a substantially cylindrical portion having an outer peripheral bearing surface which extends around substantially the whole of the outer periphery of the cylindrical portion, and a plurality of enclosed passages which pass internally through the stabilizer body generally in the direction of the longitudinal axis of the stabilizer.

In use, drilling fluid passing along the annulus between the drill string and the walls of the borehole passes through the enclosed passages in the stabilizer body. Since the peripheral bearing surface of the stabilizer body is not interrupted by outwardly facing slots, the axial length of the bearing surface may be reduced while maintaining its overall area. Not only does the continuous bearing surface improve the stability of the stabilizer, but the reduction in axial length of the bearing surface may improve the directional response of the stabilizer when used in a steerable drilling system.

The stabilizer body may be formed from a plurality of annular rings of the same diameter secured axially together, the rings being formed with registering ports spaced circumferentially apart, the combination of the registering ports on the stacked rings forming the aforementioned enclosed passages within the stabilizer body. The rings may be mounted around a central tubular mandrel having at its upper and lower ends means for connection to the drill string and a central passage for the flow of drilling fluid through the stabilizer. The stacked rings may be subject to compression while being secured to the central mandrel so as to prevent leakage from the enclosed passages formed by the ports in the rings.

In an alternative construction, the enclosed passages may be formed in a one piece hollow sleeve which is mounted on a central tubular mandrel having a central passage and means for connection to the drill string. Alternatively, the stabilizer may have any of the forms of construction described above for the gauge region of a rotary drill bit.

BRIEF DESCRIPTION OF THE DRAWINGS

The foregoing and other advantages of the invention may become apparent upon reading the following detailed description and upon reference to the drawings in which.

DETAILED DESCRIPTION OF SPECIFIC EMBODIMENTS

Figure 1:
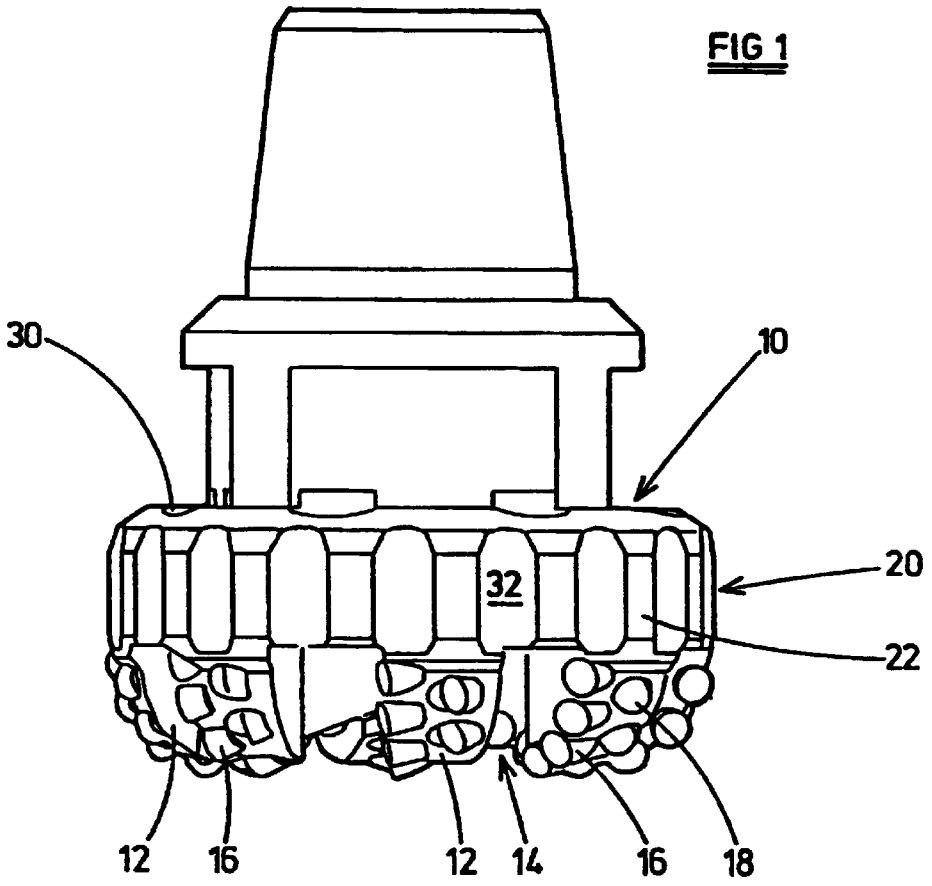
FIG. 1 is a side elevation of one form of PDC drill bit in accordance with the present invention.
Figure 2:
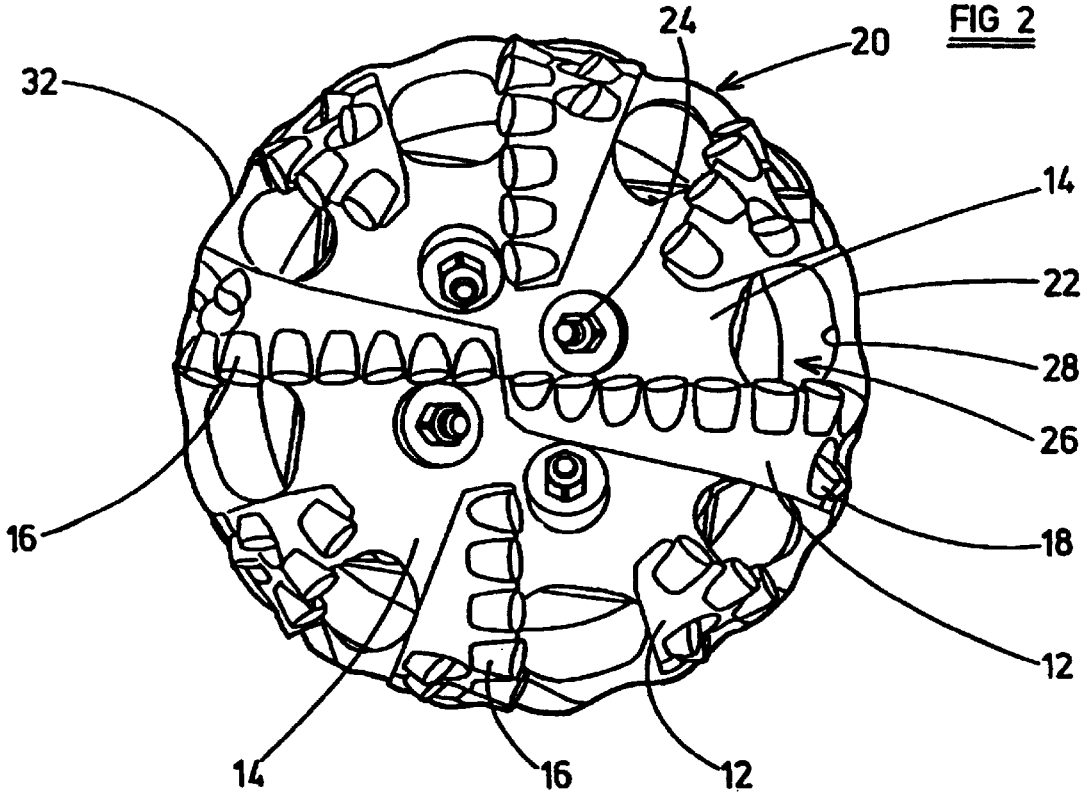
FIG. 2 is an end view of the drill bit shown in FIG. 1.

Turning to the drawings, and referring initially to FIGS. 1 and 2, the drill bit includes a bit body 10. Eight blades 12 are formed on the leading face of the bit and extend outwardly away from the axis of the bit body 10 towards the gauge region 20. The gauge region 20 of the bit body 10 includes a substantially continuous bearing surface 22 which extends around the whole of the gauge region 20.

Extending side-by-side along each of the blades 12 are a plurality of cutting structures 16. Each cutting structure 16 may be a preform cutting element brazed to a cylindrical carrier which is embedded or otherwise mounted in one of the blades 12. The cutting element may be a preform compact having a polycrystalline diamond front cutting table bonded to a tungsten carbide substrate, the compact being brazed to a cylindrical tungsten carbide carrier. Alternatively, the substrate of each preform compact may be of sufficient axial length to be mounted directly in the blade, so that the additional carrier may be omitted.

The cutting elements are set with a high back rake of about 25° on the nose of the drill bit, increasing to about 40° on the shoulder, adjacent the gauge region 13, to reduce the reactive torque. The gauge region 13 of the drill bit also has increased protection provided by the addition of back-up cutters 18 disposed rearwardly of the outer two primary cutters on each blade. Instead of the further cutters 18, back-up may be provided, on some or all of the blades, by domed studs which may be plain tungsten carbide or may be impregnated with natural or synthetic diamond.

The back-up cutters 18 may have the same exposure as the primary cutters 16, i.e., they may project to the same distance form the surface of the blade on which they are mounted. Alternatively, they may have higher or lower exposure. Similarly, the back rake of the back-up cutters 18 may be the same as the primary cutters 16 or they may have a greater or smaller back rake angle.

Each back-up cutter 18 may be located at the same radial position as a corresponding primary cutter 16 so as to follow the groove in the formation cut by its associated primary cutter. Each back-up cutter may be located on the same blade as its associated primary cutter, or it may be on a different blade.

Alternatively, the back-up cutters 18 may be located at radial positions which are intermediate the radial positions of the associated primary cutters, so that each back-up cutter removes from the formation the upstanding kerf left between the two grooves cut by adjacent primary cutters. This provides a smoother surface to the borehole.

Channels 14 are defined between adjacent blades 12. The channels 14 between the blades 12 do not lead to conventional junk slots extending upwardly through the gauge region to the annulus. Rather, the channels 14 continue up to the continuous bearing surface 22 of the gauge region. Formed in each channel 14 adjacent the gauge region is a shaped opening 26 leading into an enclosed passage 28 which extends axially through the bit body to an outlet 30 (see FIG. 1) which communicates, in use, with the annulus between the drill string and the surrounding formation forming the walls of the borehole.

Although the internal passages 28 passing through the bit body 10 may extend generally axially of the bit, as shown, they may also be arranged to extend generally helically around the longitudinal axis so that the forward rotation of the drill bit tends to enhance the flow of fluid upwardly along the passages to the annulus.

Inner nozzles 24 are mounted in the surface of the bit body 10 and are located fairly close to the central axis of rotation of the bit. The inner nozzles 24 are positioned to give efficient cleaning in the central region of the bit and are also directed to deliver drilling fluid outwardly along the channels 14 between the blades 12. Each inner nozzle 24 may be so orientated that it directs drilling fluid outwardly along both of the fluid channels 14 with which it communicates. However, each nozzle 24 may be advantageously orientated to deliver drilling fluid along the channel on the leading side of its adjacent longer blade 12, so as to clean and cool the cutters 16 mounted on that blade.

Additional outer nozzles (not shown) may then be located in the passages 28 which are disposed on the leading sides of the shorter blades 12. These four outer nozzles may be directed to the outer shoulder of the drill bit where a higher proportion of hydraulic energy is required to clean the increased cutter count in this region due to the back-up cutters 18. However, fluid flow from the inner nozzles 24 creates a pressure difference such that fluid from the outer nozzles also flows inwardly towards the inner nozzles 24, across the primary cutters on the shorter blades, before flowing outwardly again with the outward flow from the inner nozzles 24. All of the nozzles communicate with a central axial passage (not shown) in the shank of the bit, to which drilling fluid is supplied under pressure downwardly through the drill string in known manner. Flow from both the inner nozzles 24 and the outer nozzles flows to the annulus through the openings 26 and passages 28 through the bit body.

The provision of the continuous bearing surface 22 around the whole of the gauge region 20 of the drill bit, instead of providing junk slots in the gauge region, substantially enhances the stability of the bit in operation. It reduces the bit's susceptibility to vibration due to the absence of sharp edges, cutting elements, or other protrusions in the gauge region which otherwise might act on surrounding formation to cause vibration and, under some circumstances, to initiate "bit whirl." Bit whirl is a phenomenon in which the drill bit begins to precess around the hole in the opposite direction to the direction of rotation of the drill bit. One result of bit whirl is that some cutters may temporarily move in the reverse direction relative to the formation and this can result in damage to the cutting elements.

Furthermore, the provision of a continuous bearing surface around the whole periphery of the drill bit allows the axial length of the gauge region 20 to be reduced as compared with conventional drill bits while maintaining the desired overall area of the bearing surface. As may be seen from FIG. 1, the gauge length of the drill bit is considerably less that is normally the case with a conventional PDC drill bit. The reduction in axial length of the gauge region also reduces the distance form the motor to the bit, in a steerable motor-driven system, thereby improving the directional response of the drill bit when steering is taking place.

As previously mentioned, the continuous bearing surface 22 may be subject to erosion and wear in use as a result of its substantially constant bearing on the surrounding formation. The drill bit of FIGS. 1 and 2 incorporates one arrangement for reducing erosion and wear of the bearing surface 22 while at the same time maintaining the beneficial advantages of a continuous bearing surface.

The gauge region bearing surface 22 is formed with a plurality of shallow subsidiary channels 32 which extend axially of the gauge region and are spaced apart, advantageously by equal distances, around the bearing surface 22. As may be seen from FIG. 2, each subsidiary channel 32 is shallow and of significantly smaller cross-sectional area than the main fluid channels 14 between the blades 12. Consequently, most of the drilling fluid flowing along the main channels 14 flows directly to the annulus through the internal passages 28 through the bit body. However, a minor proportion of the fluid can escape from the channels 14 and into the shallow subsidiary channels 32, thus lubricating and cleaning the bearing surface 22 so as to reduce wear and erosion of the bearing surface.

Each subsidiary channel 32 has a width which is several times the depth of the channel and, due to this shallowness, each subsidiary channel 32 may form an effective part of the bearing surface 22. To enhance this bearing effect, the longitudinal edges of the subsidiary channels 32 may blend smoothly with the adjacent surfaces of the gauge region 20.

Figure 3:
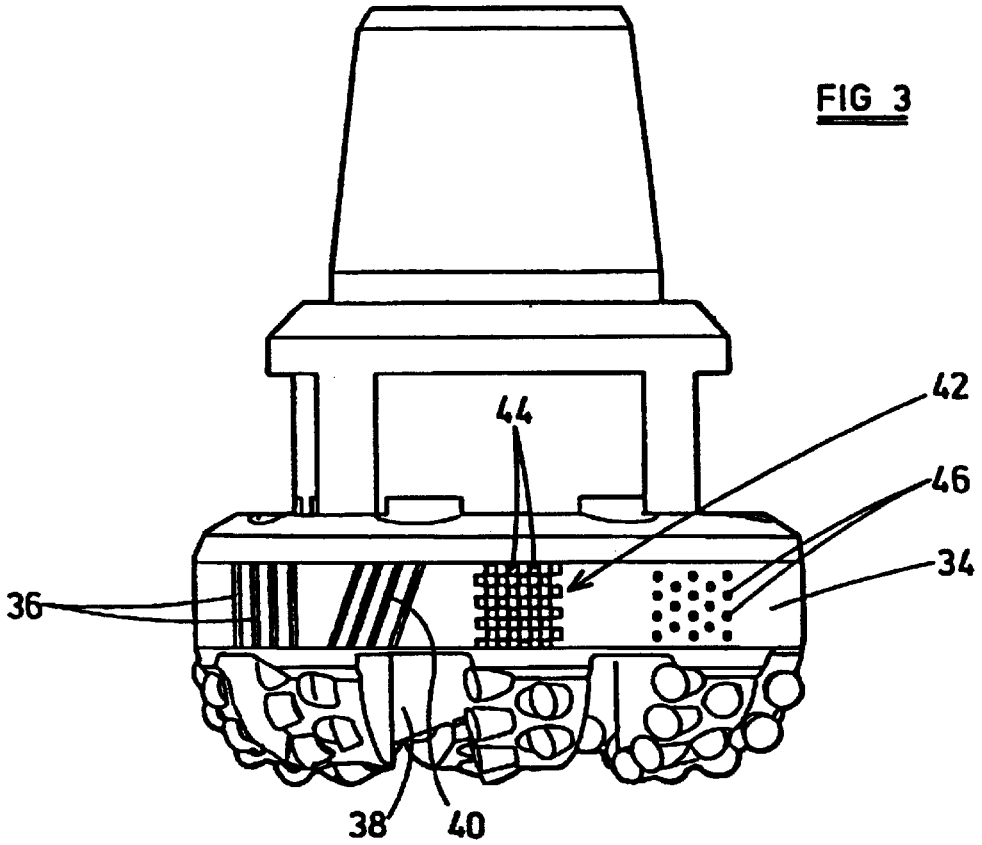
FIG. 3 is a side elevation of a drill bit similar to that shown in FIGS. 1 and 2, but showing various alternative configurations for the bearing surface of the gauge region.

Although the subsidiary channels 32 are shown as extending in a direction that is generally parallel to the longitudinal axis of the drill bit, other arrangements where the channels are inclined to that axis, for example extend helically around the gauge region, may also be advantageous. Additionally, cleaning and lubrication of the bearing surface 22 may also be achieved by forming the subsidiary channels 32 as spaced recesses in the bearing surface 22, where such recesses are not in direct communication with the fluid channels 14 in the leading face of the bit body. FIG. 3 is a similar view to FIG. 1 showing a number of alternative configurations of the bearing surface 34 of the drill bit in order to provide lubrication to the bearing surface.

As in the previous arrangement, the bearing surface 34 of FIG. 3 extends continuously around the whole of the periphery of the gauge region 20 of the drill bit. For the purposes of illustration, the bearing surface 34 is shown with four different configurations in different regions thereof. In practice, it is envisaged that the same surface configuration would be applied around the whole of the bearing surface, either continually or in circumferentially spaced regions. However, different configurations may be used in different regions of the bearing surface.

Referring to FIG. 3, instead of the wide and shallow subsidiary grooves 32 shown in FIGS. 1 and 2, the bearing surface 34 may be formed with a parallel series of narrow and shallow grooves as indicated at 36. These grooves extend generally parallel to the longitudinal axis of the drill bit and may communicate at their lower ends with the fluid channels 38 between the blades on the lower leading face of the drill bit, so that a minor proportion of the fluid in the main channels 38 can escape into the narrow subsidiary channels 36 to lubricate the bearing surface. However, as in the previous embodiment, the subsidiary channels 36 may have closed ends. In this case, they may retain drilling fluid which leaks across the gauge region of the drill bit as a result of unevenness in the surrounding formation, and thus still perform a lubricating function. Instead of extending axially, the narrow subsidiary channels 36 may be inclined so as to extend helically around the bearing surface 34 as indicated at 40.

Another configuration is indicated at 42 where the bearing surface 34 is formed with an array of shallow rectangular recesses 44 arranged in a checkerboard formation. Again, the shallow recesses will, in use, capture leaking drilling fluid and promote lubrication of the bearing surface 34. Alternatively, the recesses may be an array of shallow circular blind holes as indicated at 46.

In an alternative arrangement, at least some of the narrow subsidiary channels 36 may include or constitute narrow apertures which extend completely through the bit body so as to open into the adjacent enclosed passage 37 which pass internally through the bit body. In this case, drilling fluid for the purposes of lubricating the bearing surface may leak outwardly from the passages 37 through said apertures and directly into the channels 36.

The portions of the bearing surface 22 between the subsidiary channels 32 or 36 may incorporate gauge protection provided by inserts (now shown) which may comprise a mixture of polycrystalline diamond compacts having their front face substantially flush with the bearing surface 22, and inserts impregnated with natural or synthetic diamond, which are also substantially flush with the bearing surface 22.

Figure 4:
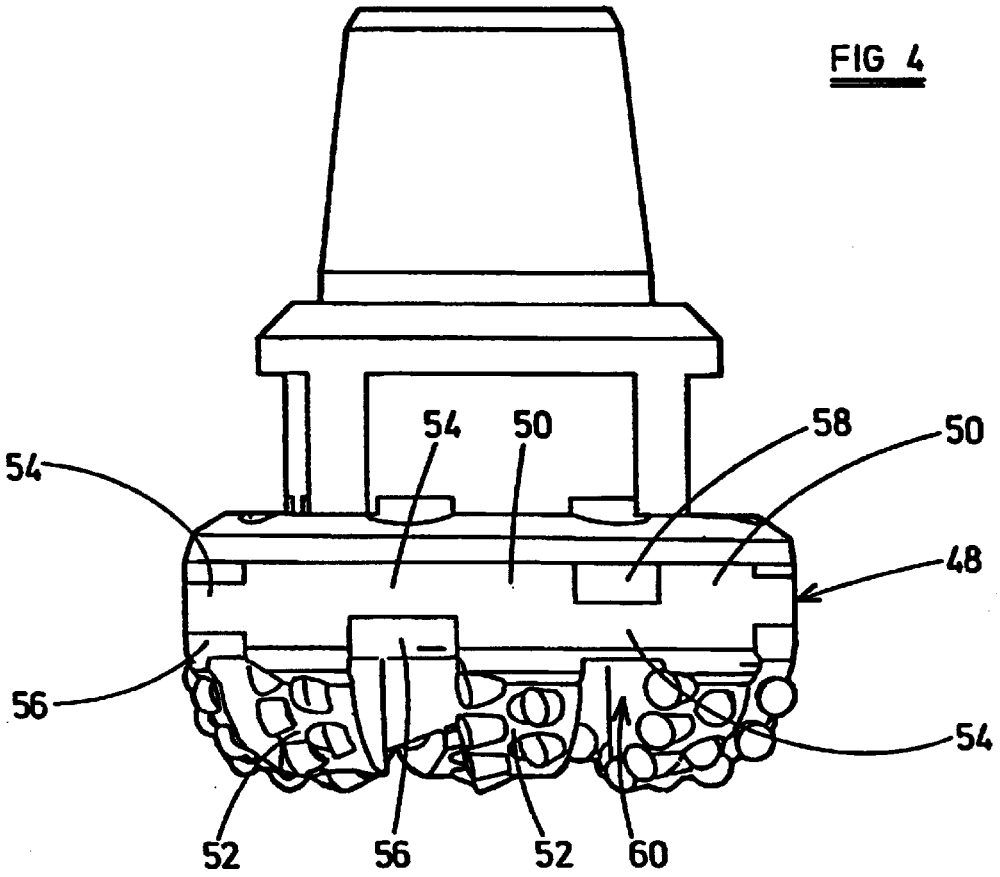
FIG. 4 is a similar view showing an alternative configuration for the bearing surface of the gauge region.

FIG. 4 shows an arrangement in which certain areas of the bearing surface are of smaller height, in the longitudinal direction, than the overall height of the gauge region, where adjacent areas of smaller height are displaced relative to one another in the longitudinal direction. Referring to FIG. 4, the bearing surface of the gauge region 48 of the drill bit comprises eight areas 50 of the bearing surface which extend upwardly across the gauge from the outer ends of the blades 52 on the leading face of the drill bit. Between each pair of adjacent areas 50 is an area 54 of the bearing surface which is of smaller height so that the region below area 54 of the bearing surface, and/or the region 58 above it, is in the form of a recess 56. The recesses 56 below the bearing surface areas 54 are in communication with the corresponding fluid channels 60 in the leading face of the bit between the blades 52.

The bearing surface regions 54 are arranged at different heights on the gauge region. The effect of this is that the bearing surface areas 50 and 54 form a continuous bearing surface extending around the whole periphery of the gauge region, to enhance bit stability and resistance to bit whirl of a bit of this type. However, since the regions 54 are arranged at different heights, during each revolution of the drill bit the different regions 54 will engage different parts of the surround formation, making it less likely that hard occlusions in the formation will cause similar wear on all regions of the continuous bearing surface. Of course, the arrangement of smaller bearing surface areas shown in FIG. 4 may be combined with any of the surface configuration features described in relation to FIG. 3.

As previously explained, drill bits having a substantially continuous gauge bearing surface are particularly suitable for use with steerable drilling systems in view of their good directional response. This characteristic may be enhanced by tapering the profile of the continuous bearing surface as indicated at 62 in FIG. 5. In this arrangement, the bearing surface 62 is generally frusto-conical in shape. Again, the tapered bearing surface 62 may incorporate any of the other bearing surface features described herein. The frusto-conical shape may be angled to suit the build angle of the deviated borehole during steered drilling. For example, the angle of taper of the gauge region may match the bent sub-angle distance from the bit face to the bend angle. This enables higher build rates to be achieved in directional drilling.

Aspects of the invention may also be applied to drill bits of the kind having a leading pilot bit part of smaller diameter than the main part of the bit, so that the pilot part first creates a pilot bore which is subsequently reamed to a larger diameter by the following main part of the drill bit. Such a drill bit is shown in FIG. 6.

Figure 6:
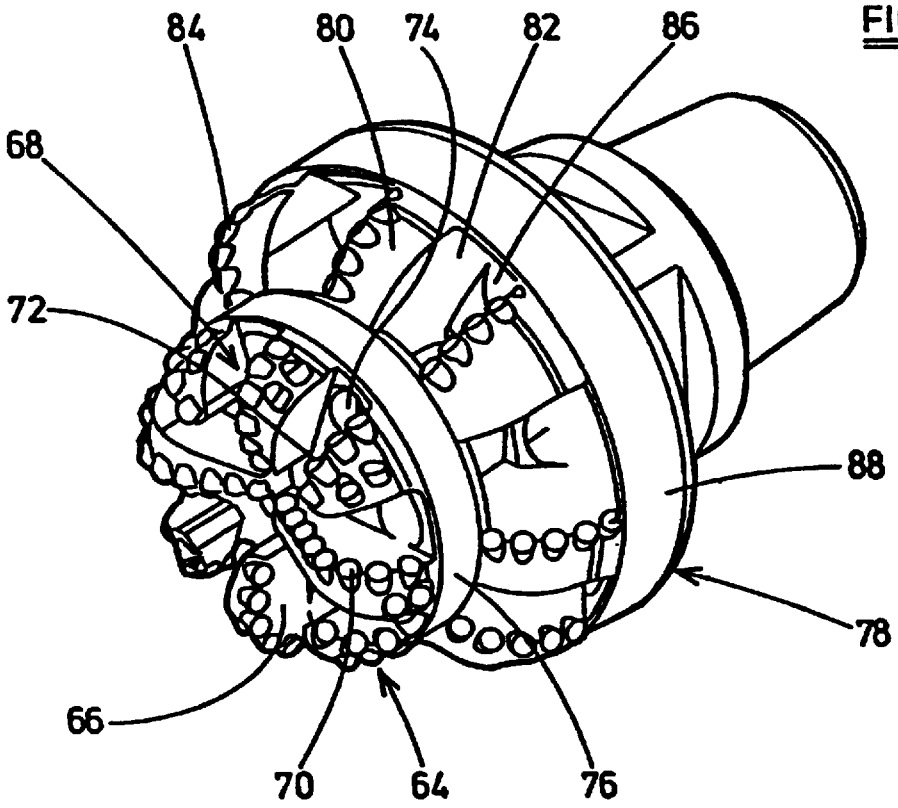
FIG. 6 is a perspective view of another form of PDC drill bit in accordance with the invention, the bit having a pilot bit part.

Referring to FIG. 6, the drill bit comprises a pilot bit part 64 which is generally similar to the construction of the lower end part of the drill bit shown in FIGS. 1 and 2. That is to say, the main body of the pilot bit part has eight spaced blades 66 formed on its leading face, defining channels 68 between adjacent blades. Cutters 70 are mounted side-by-side along each of the blades 66.

Nozzles 72 near the axis of the bit supply drilling fluid to the channels 68. The drilling fluid escapes from the channels 68 through enclosed passages 74 which pass axially through the main body of the pilot bit part. The gauge region of the pilot bit part is formed with a continuous bearing surface 76 which extends around the whole of the gauge region.

The main, reaming part of the bit 78 is similarly formed with circumferentially spaced blades 80 which carry cutters 84. Fluid channels 82 are formed between the blades 80. The drilling fluid from the nozzles 72 on the pilot bit part is delivered into the channels 82 in the main bit part through the passages 74, and further internal passages 86 adjacent the outer ends of the fluid channels 82 on the main bit part pass internally through the body of the main bit part to deliver the drilling fluid to the annulus between the drill string and the surrounding wall of the borehole. In this case, the gauge region of the main bit part 78 is also formed with a continuous bearing surface 88 which extends around the whole of the gauge region.

A drill bit of the kind shown in FIG. 6 may be extremely stable since the increase in stability which is normally provided by a leading pilot bit part may be enhanced by the additional stabilizing effects of the continuous gauge bearing surfaces 76 and 88. However, as previously mentioned, one possible disadvantage of drill bits having a bearing surface which extends around the whole of the gauge is that the bearing surface may foul the walls of the borehole while tripping in and out of the borehole and this, when tripping into the borehole, may lead to balling up of the bit. To reduce this possibility, the continuous gauge bearing surface 88 on the main part 78 of the drill bit may be omitted and the internal passages 86 may be replaced by conventional outwardly facing junk slots. In that case, the engagement of the continuous circumferential bearing surface 76 on the pilot part of the bit with the surrounding wall of the pilot bore will alone provide enhanced stability of the bit, but will not interfere with tripping the bit into and out of the borehole, since the borehole will be of larger diameter than the pilot bit part.

Figure 6A:
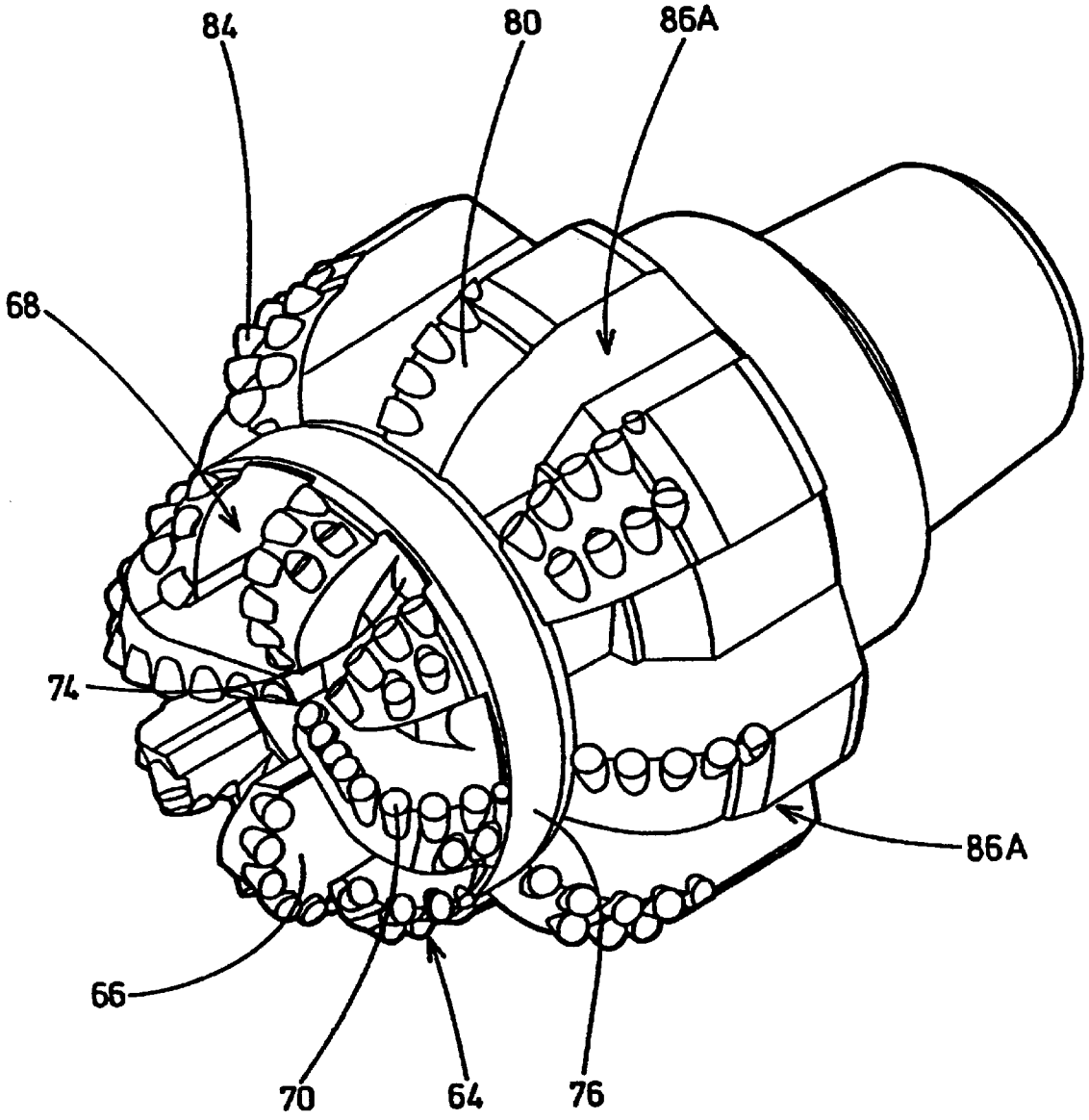
FIG. 6A is a perspective view of a modified version of the drill bit shown in FIG. 6.

Such an arrangement is shown in FIG. 6A, where the channels between the blades on the main part of the bit body lead to conventional junk slots 86A passing axially through the gauge region of the main bit part. Apart form this modification the drill bit is generally similar to that shown in FIG. 6 and corresponding elements of the drill bit bear the same reference numerals.

In a modified version of the drill bit shown in FIG. 6, the bearing surface 76 on the pilot bit part 64 may extend only around one half of the gauge region of the pilot part, the other half of the gauge region being provided with conventional junk slots instead of the internal passages 74. Similarly, the continuous bearing surface 88 on the main bit part 78 may also extend around only one half of the gauge region of the main bit part, e.g., the half which is diametrically opposite the half of the bit where the pilot bit part has a continuous gauge bearing surface. The effect of this arrangement is that a bearing surface extends around the whole periphery of the bit, considered as a whole, but half of the bearing surface is on the main part of the bit and the other half is on the pilot part. This arrangement may also provide the stability advantages of a continuous gauge bearing surface, while reducing the possibility of the gauge fouling the walls of the borehole during tripping in or out.

It will be appreciated that different proportions of the bearing surfaces may be shared between the main bit part and the pilot part. For example, the main bit part may have around its gauge a number of sections of bearing surface which alternate, in their angular position and extent, with spaced bearing surface areas on the gauge region of the pilot bit part 64. It will be appreciated that the effect of this will be somewhat similar to the arrangement shown in FIG. 4 where different areas of the bearing surface are displaced relative to one another in the axial direction.

Figure 7:
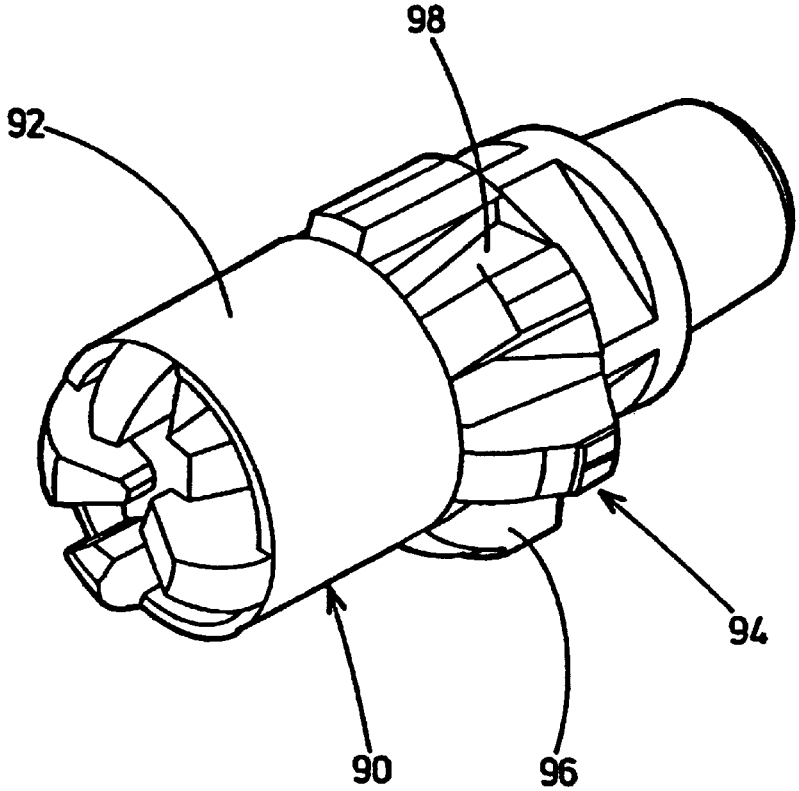
FIG. 7 is a similar perspective view of a bicentric bit having a pilot bit part.

The arrangements described in relation to FIG. 6 may also be applied to a bicentric bit, as shown in FIG. 7. In this case, the pilot bit part 90 (which is shown only diagrammatically, the cutters, nozzles and internal passages being omitted) is provided with a continuous gauge bearing surface 92 which extends around the whole of the gauge. The main bit part 94 does not have a continuous gauge bearing surface. Rather, it is provided with a series of circumferentially spaced reaming blades 96 which are, in any suitable manner, eccentrically arranged in relation to the longitudinal axis of the bit.

The reaming section 94 has a maximum cross dimension less than the diameter of the borehole which is cut by the eccentrically arranged reaming blades 96 as the drill bit rotates, the bit being centered in the borehole by the engagement of the pilot bit part 90 with the pilot bore. This eccentric arrangement allows the bit to be passed through a portion of an existing borehole which is of smaller diameter than the diameter of the borehole which the bit will itself cut.

Drilling fluid passing through the internal passages (not shown) in the pilot bit part 90 flows into the channels 98 between the reaming blades 96 and into the annulus between the drill string and the surrounding borehole. The provision of the continuous bearing surface 92 on the drill bit part 90 stabilizes the whole drill bit and inhibits vibration and the initiation of bit whirl.

Figure 8:
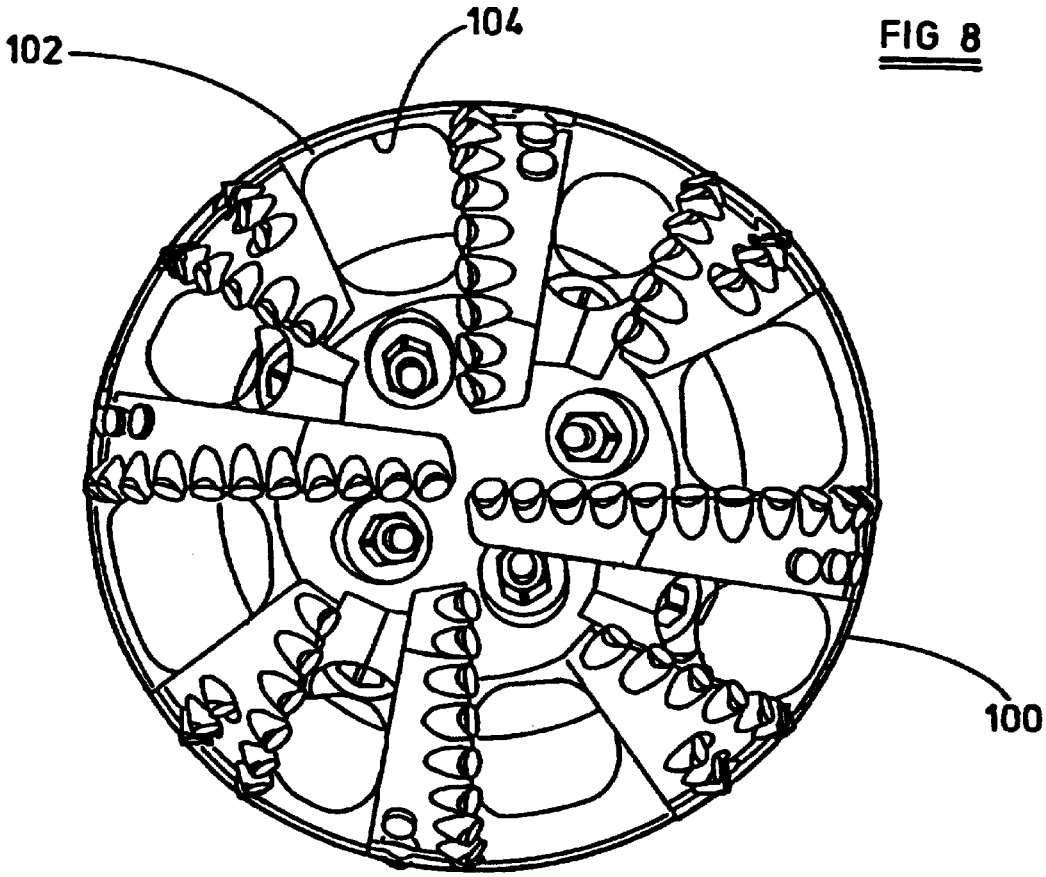
FIG. 8 is an end view of a further form of PDC drill bit showing another feature of the present invention.

FIG. 8 is an end view of a further form of drill bit. The general construction of the drill bit is similar to that of the drill bit shown in FIGS. 1 and 2, as may be seen from the drawing, and its features will not, therefore, be described in detail. It should be noted, however, that the outer peripheral bearing surface 100 of the gauge region is not formed with shallow channels for lubricating the surface, although these could be provided. The feature of the drill bit shown in FIG. 8 which mainly distinguishes it from that of FIGS. 1 and 2 is that the wall thicknesses of the bit body, as indicated at 102, between the outer bearing surface 100 and the walls of the internal passages 104, differ around the circumference of the bit.

Figure 9:
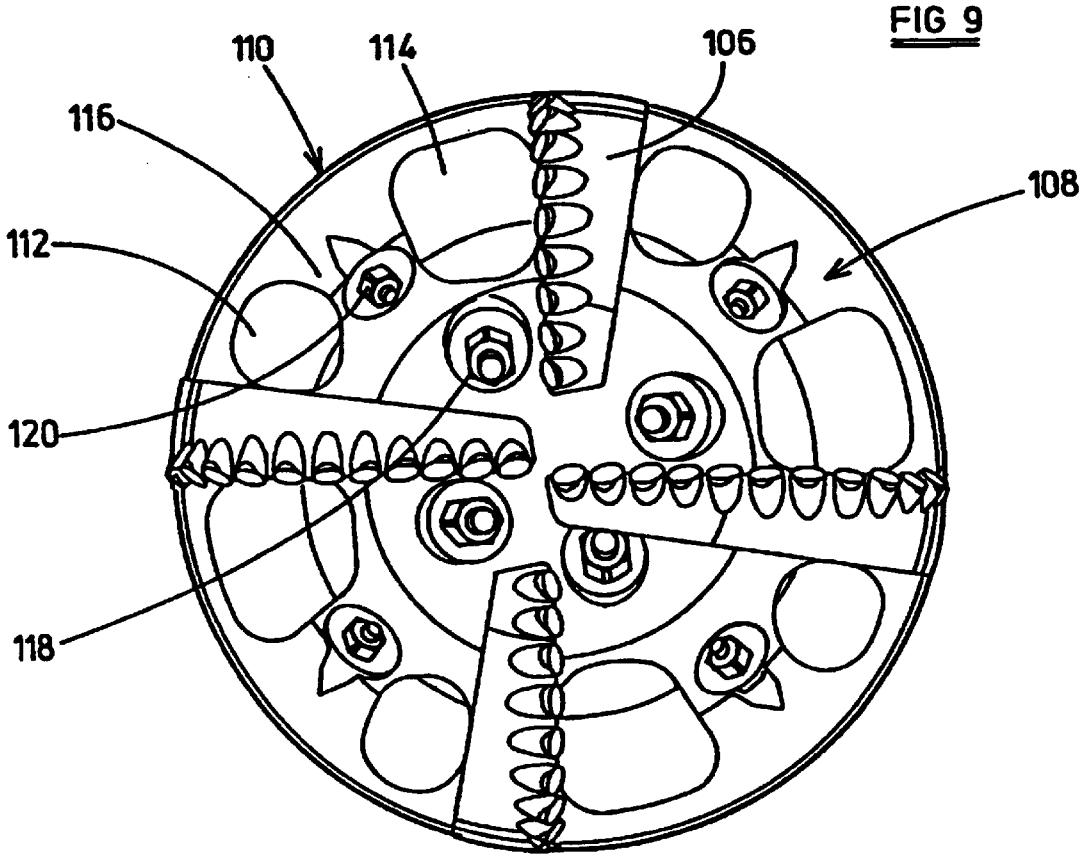
FIG. 9 is a similar view of a still further form of PDC drill bit according to the invention.

In the arrangements previously described, where the bit is provided with eight blades, there is provided a single opening, leading to an internal passage, in each channel. However, as previously mentioned, when drilling some types of formation, particularly soft formations, it may be advantageous to use a lighter set drill bit having fewer blades and cutters, since this may reduce the problem of bit balling. FIG. 9 shows such a lighter set drill bit where only four blades 106 are provided separated by channels 108 which are approximately 90° in angular extent. In such a construction, if a single large opening and passage were to be provided in the bit body, in order to deliver drilling fluid from each channel 108 past the continuous gauge region 110 to the annulus, this might result in substantial structural weakening of the drill bit, and, in particular, the gauge section.

According to the arrangement shown in FIG. 9, therefore, each channel is formed with two openings 112 and 114 which communicate with separate passages leading through the bit body to the annulus. The larger of the two openings 114 is disposed adjacent the gauge section and on the leading side of a respective blade 106, whereas the smaller opening 112 is disposed adjacent the trailing side of the preceding blade. The portion 116 of the bit body between each pair of openings 112, 114 may thus be regarded as a support strut which provides radial strength to the gauge section between the widely angularly spaced blades 148.

Four inner nozzles 118 direct drilling fluid outwardly along the leading edges of the blades 106 respectively. Four outer nozzles 120 are also provided and are mounted in the portion 116 of the bit body between the openings 112, 114. There outer nozzles 120 are oriented to direct drilling fluid generally towards the gauge region of the drill bit.

Methods of manufacturing drill bits incorporating a substantially continuous gauge bearing surface are also disclosed herein. These methods may also be useful not only ofr bits of the kinds previously described, but also for other types of bits.

Figure 10:
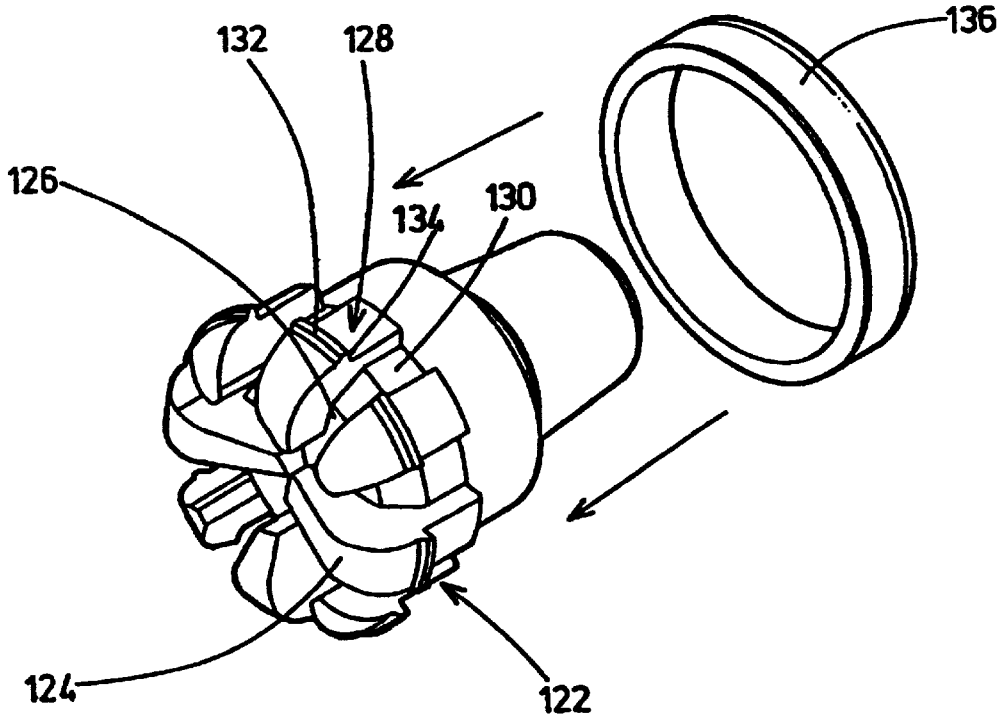
FIG. 10 is a diagrammatic perspective exploded view showing one method of manufacturing a PDC drill bit according to the invention.

One such manufacturing method is illustrated diagrammatically in FIG. 10. In this case, the drill bit body, indicated diagrammatically at 122, is formed with blades 124, on which cutters will be mounted, and fluid channels 126 between the blades 124. In the gauge region 128 of the bit body there are provided a series of circumferentially spaced axially extending slots 130 which form continuations of the fluid channels 126 between the blades. At the shoulder forming the junction between the blades 124 and the gauge section 128, each blade is formed with a circumferentially extending and upstanding shoulder 132 which provides an annular rebate 134.

If the bit body is to be used in the manufacture of an otherwise conventional PDC drill bit, there may be welded or otherwise secured to the gauge extension of each blade 124 a gauge bearing pad which fits in the rebate 134 provided by the upstanding shoulder 132. The outer surfaces of the bearing pads then provide the bearing surfaces of the gauge section and the slots 130 between the pads then act as conventional junk slots.

However, if the bit body 122 is to be used in the manufacture of a PDC drill bit having a continuous gauge bearing surface, there is fitted in the peripheral rebates 134 a separately formed gauge ring 136. The outer surface of the gauge ring 136 provides the continuous bearing surface of the gauge region, which extends around the whole of the gauge region and closes off the slots 130 in the bit body so as to convert them to enclosed internal passages. The bit body and the outer bearing surfaces of the gauge ring 136 may have any of the characteristics described in this specification.

The gauge ring 136 may be permanently secured to the bit body 122, for example by welding. However, it may also be secured to the bit body by reversible means, such as bolts or screws, so that the gauge ring can be readily removed from the bit body if required. The purpose of such removal may be simply for the purposes of repair or replacement, but the gauge ring may also be removed to convert the drill bit into a more conventional junk slot drill bit. In this case, the gauge extensions adjacent the upstanding shoulders 132 would have attached to them separate curved bearing pads, as previously described.

In an alternative method of manufacture, the continuous gauge bearing surface may be integrally formed with the bit body which is initially solid inwards of the bearing surface. The enclosed passages extending internally through the bit body may then be formed by drilling through the solid bit body or by any other appropriate machining or forming process.

As previously mentioned, the bit body may be machined from steel and the gauge ring 136 may also be machined from steel. The outer surfaces of appropriate regions of the bit body and gauge ring may be treated in any conventional way to provide wear and erosion resistance. For example, a hard facing may be applied to any of the vulnerable areas, using well known methods.

Alternatively, the bit body may be formed from solid infiltrated matrix material, by the well known process whereby a steel core is placed in a mold shaped internally according to the desired surface shape of the drill bit. The mold is packed, around the core, with powdered matrix material, such as powdered tungsten carbide, which is then infiltrated in a furnace with an appropriate metal alloy so as to form a solid infiltrated matrix.

Solid infiltrated matrix material may have certain advantages over steel for some usages. However, it may have certain disadvantages when used to form a comparatively thin gauge ring of the kind shown at 136 in FIG. 10. For example, a comparatively thin matrix gauge ring of the kind shown, although more resistant to erosion than steel, may be more susceptible to impact damage in use.

Figure 11:
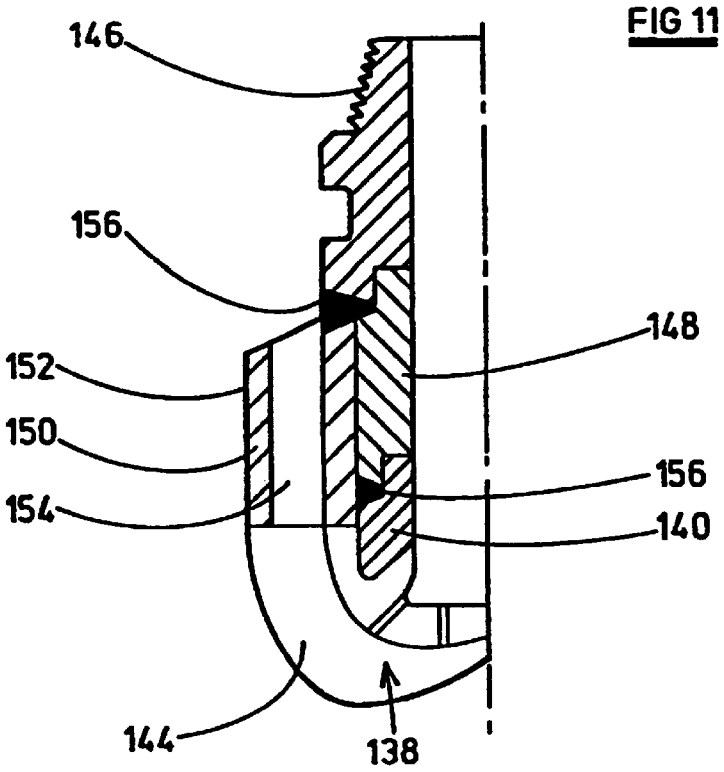
FIG. 11 is a diagrammatic half-section through a PDC drill bit showing an alternative method of manufacture.

FIG. 11 shows diagrammatically a method of manufacturing a drill bit where solid infiltrated matrix may be employed to provide the outer continuous bearing surface of the gauge section. The bit body, which is shown in half section in FIG. 11, comprises a leading section 138 having a central steel core 140 on which the leading part 138 of the bit body is molded from solid infiltrated matrix material. The matrix material provides the leading face 142 of the bit as well as the blades 144 on which the cutters are mounted. The steel core 140 is connected to a steel threaded shank portion 146 of the bit by an intermediate steel tubular mandrel 148. The mandrel 148 is in screw-threaded engagement with both the shank portion 146 and the core 140 of the leading portion of the bit.

The gauge section of the bit body is provided by an annular ring 150 which is also molded from solid infiltrated matrix material. However, unlike the arrangement shown in FIG. 10, the ring 150 not only provides the outer continuous bearing surface 152 of the drill but is also of sufficient radial thickness to incorporate the enclosed passages 154 which extend through the bit body to pass drilling fluid from the fluid channels between the blades 144 to the annulus. The matrix gauge ring 150 closely encircles the mandrel 148 and closely abuts the upper surface of the matrix leading portion of the drill bit, and is welded to the core 140, the mandrel 148, and the shank portion 146 as indicated at 156.

Figure 12:
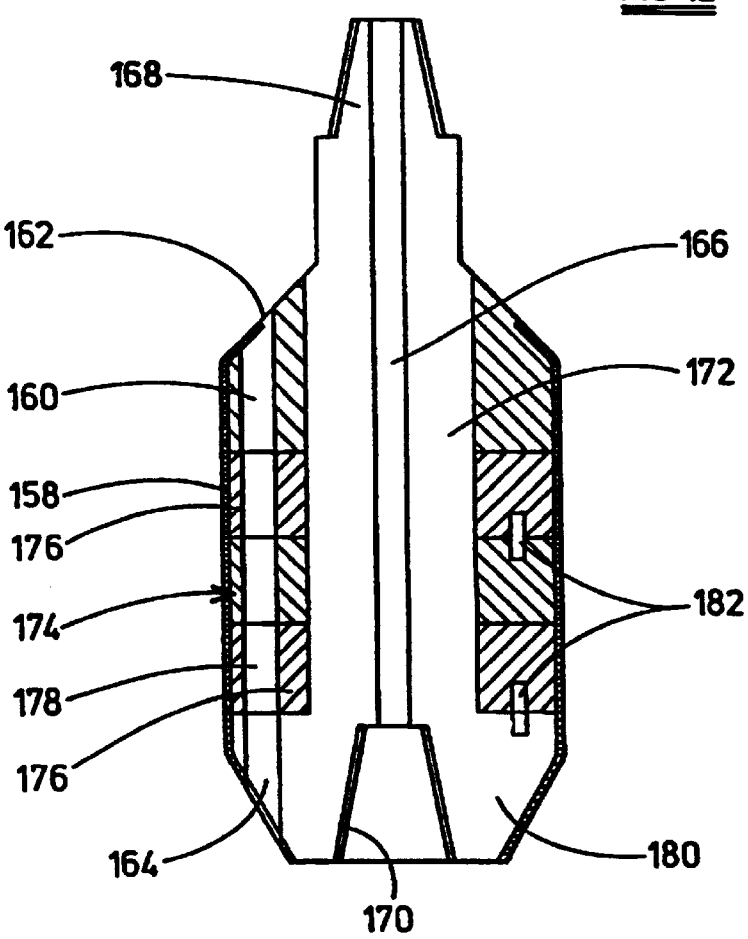
FIG. 12 is a diagrammatic longitudinal section through a stabilizer showing features of the present invention.

FIG. 12 shows diagrammatically the application of a continuous external bearing surface to a stabilizer. As is well known, stabilizers may be inserted in a drill string. Stabilizers generally include a hollow body having radially extending blades which are formed at their outer extremities with bearing surfaces which bear against the walls of the borehole. The blades are separated by slots through which drilling fluid may flow along the annulus past the stabilizer.

FIG. 12 diagrammatically illustrates a stabilizer where the outer bearing surface 158 of the stabilizer is continuous and extends around the whole periphery of the stabilizer so as the make 360° contact with the wall of the borehole. In order to permit the passage of drilling fluid past the stabilizer, the interior of the stabilizer is formed with longitudinally extending passages 160 which extend between openings 162 and 164 at the upper and lower ends of the stabilizer respectively. The stabilizer has a central passage 166 and a threaded shank 168 at its upper end and a threaded socket 170 at its lower end for connection within the drill string.

The stabilizer may be made in one piece, the circumferentially spaced axial passages 160 being drilled or otherwise formed through the solid material of the stabilizer. Alternatively, the stabilizer may comprise a central tubular portion 172 surrounded by an annular sleeve 174 formed with the passages 160.

Specialized equipment, known in the art, may be required to drill long passages through the one piece body of the stabilizer and, in order to simplify manufacture, the outer sleeve of the stabilizer may be formed, as shown in FIG. 12, from a stack of separate rings 176. Each ring 176 is formed with a number of ports 178 which, when the rings are stacked, come into register to form the internal passages 160.

In order to prevent leakage between the rings in use, the rings may be axially compressed against an integral abutment portion 180 on the lower end of the central tube 172 while the upper ring is welded to the tube 172. Pins or keys 182 may be provided to prevent relative rotation between the rings 176 and the whole outer face of the stabilizer may be provided with a hardfacing. The hardfacing may be applied to the outer peripheries of the rings 176 before they are assembled together to form the stabilizer body. In order to ensure accuracy of fitting, the rings may be ground on their outer diameter and on both faces.

Figure 13:
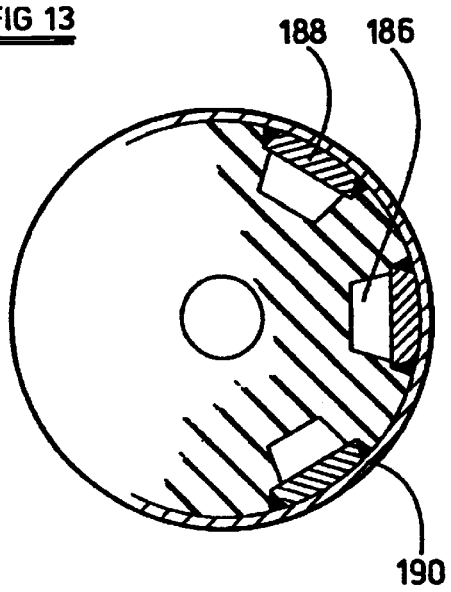
FIGS. 13 and 14 are diagrammatic cross-sections through stabilizers showing alternative methods of construction.
Figure 14:
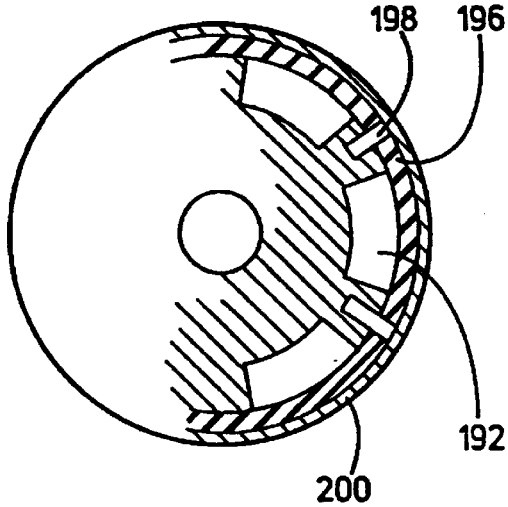

Two alternative methods of manufacturing stabilizers are shown in FIGS. 13 and 14. In the arrangement of FIG. 13 the main stabilizer body 184 is formed around its periphery with a number of spaced longitudinal channels 186, such channels readily being formed by machining. The channels are then closed by respective elongate metal plates 188 welded across the open faces of the channels 186. The outer surface of the stabilizer body is then ground to circularity, and a hardfacing 190 is applied. The closed channels 186 then provide the required passages through the stabilizer for the flow of drilling fluid and the external surface of the stabilizer provides the continuous bearing surface.

In the modified arrangement shown in FIG. 14, the channels 192 in the main stabilizer body 194 are closed by a tubular sleeve 196 which is shrink-fitted on to the stabilizer body 194 and then held against rotation by radial pins 198. A hardfacing 200 is then applied to the outer surface of the stabilized body, as before.

Figure 15:
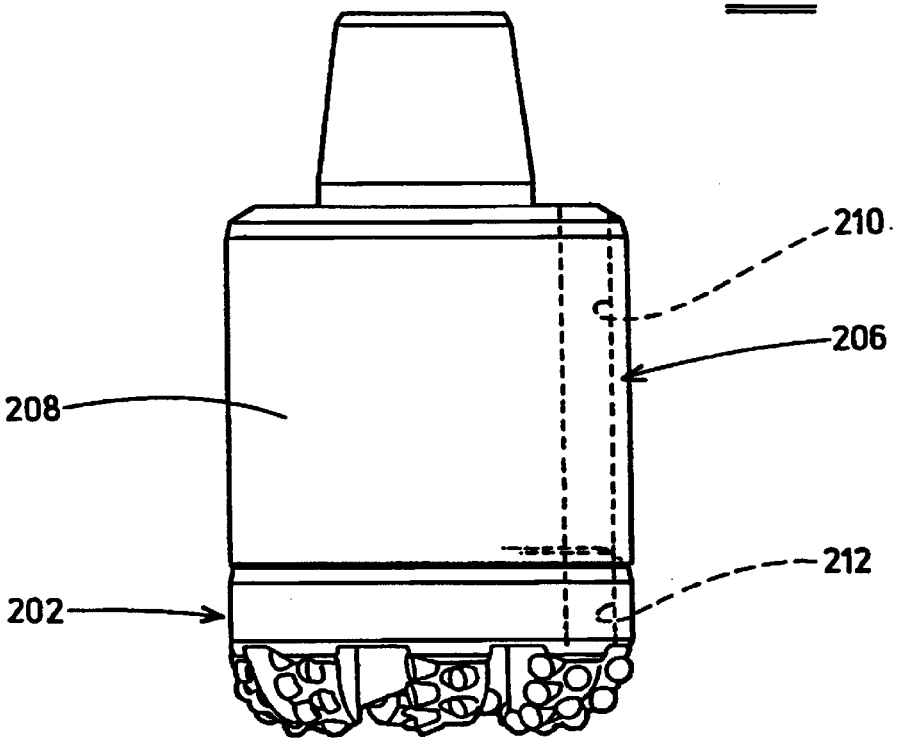
FIG. 15 is a side elevation showing the combination of a PDC drill bit and a near-bit stabilizer, both in accordance with the present invention.

FIG. 12 shows a stabilizer for inclusion in the drill string. In certain circumstances, however, it may be desirable to provide a near-bit stabilizer which essentially provides a close extension to the gauge section of the drill bit. FIG. 15 shows such an arrangement. Here, the drill bit 202 is similar in construction to the drill bit shown in FIGS. 1 and 2 and comprises a gauge bearing surface 204 which extends continuously around the whole of the gauge section. The near bit stabilizer 206 encircles the upper part of the drill bit, in generally known manner. In the present case, however, the external bearing surface 208 of the stabilizer 206 also extends continuously for 360° around the entire periphery of the stabilizer and the internal open-ended passages 210 which register with the internal passages 212 in the drill bit 202. The stabilizer 206 may be manufactured, for example, by any of the methods described in relation to FIGS. 12–14.

Figure 16:
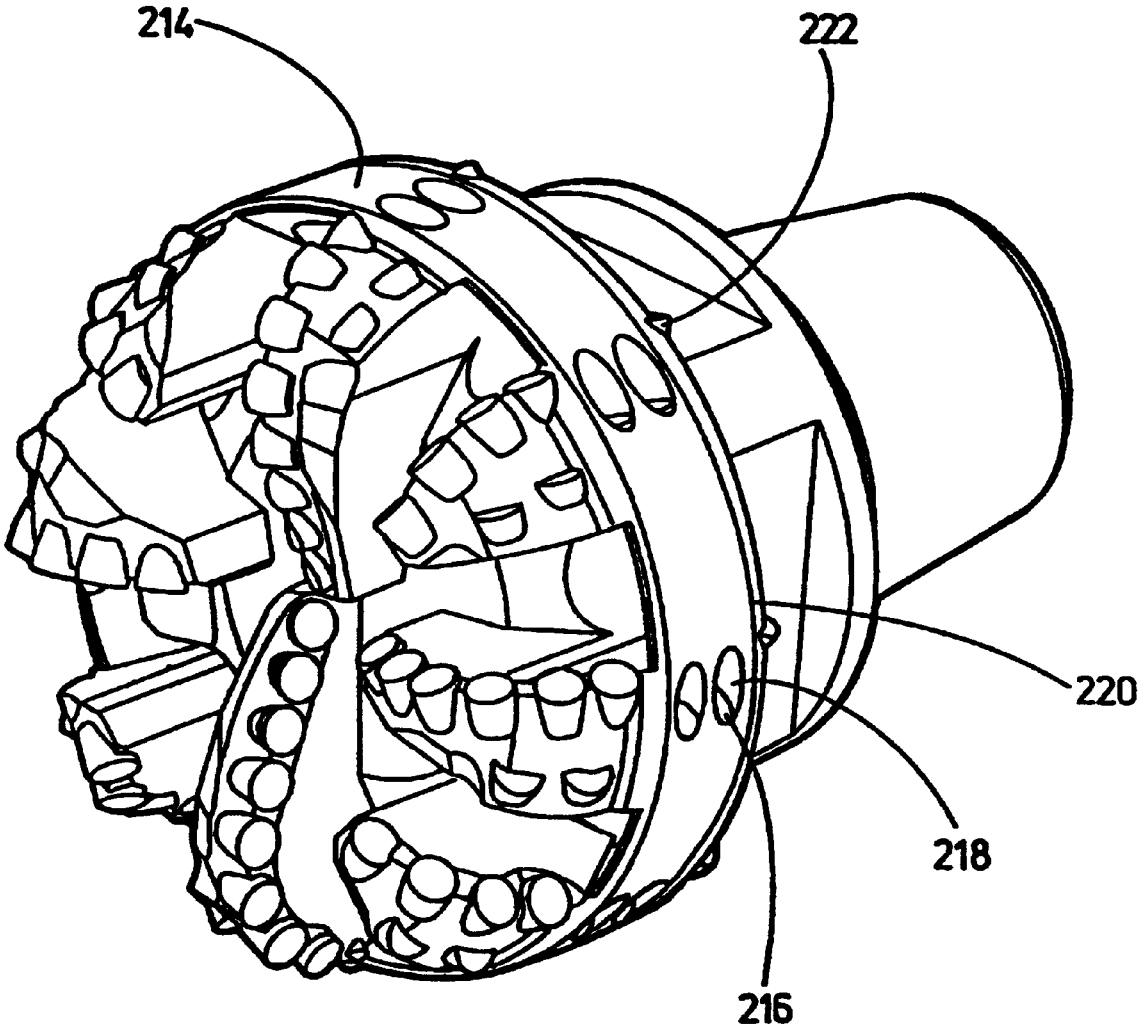
FIGS. 16, 17, and 18 are perspective views of further forms of drill bit.

FIG. 16 is a perspective view of a drill bit which is generally similar to the drill bit shown in FIGS. 1 and 2 except for the form of the gauge region 214 of the bit. In this case, the peripheral surface of the gauge region is substantially smooth and continuous around the whole periphery of the bit body. However, the gauge region includes gauge cutters 216. Each cutter 216 is mounted in a socket 218 in the gauge so that the cutting edge of each gauge cutter 216 projects only a very short distance form the surface of the gauge. The gauge cutters 216 are in pairs spaced circumferentially apart around the gauge. Each pair of gauge cutters is mounted in the region of the gauge which forms a continuation of each of the blades on the leading face of the bit, so that the cutters are fully supported by the bit body. The gauge cutters 216 may be combined with gauge protecting inserts which may comprise, for example, studs received in sockets in the gauge with their outer surfaces substantially flush with the bearing surface of the gauge. Such inserts may comprise tungsten carbide studs, studs impregnated with natural or synthetic diamond, or polycrystalline diamond compacts having their diamond facing tables substantially flush with the bearing surface of the gauge.

In the arrangement of FIG. 16, the edge of the gauge region 214 remote from the leading face of the drill bit is frusto-conically chamfered, as indicated at 220 and mounted on the chamfered portion of the gauge region are back-reaming cutters 222.

Figure 17:
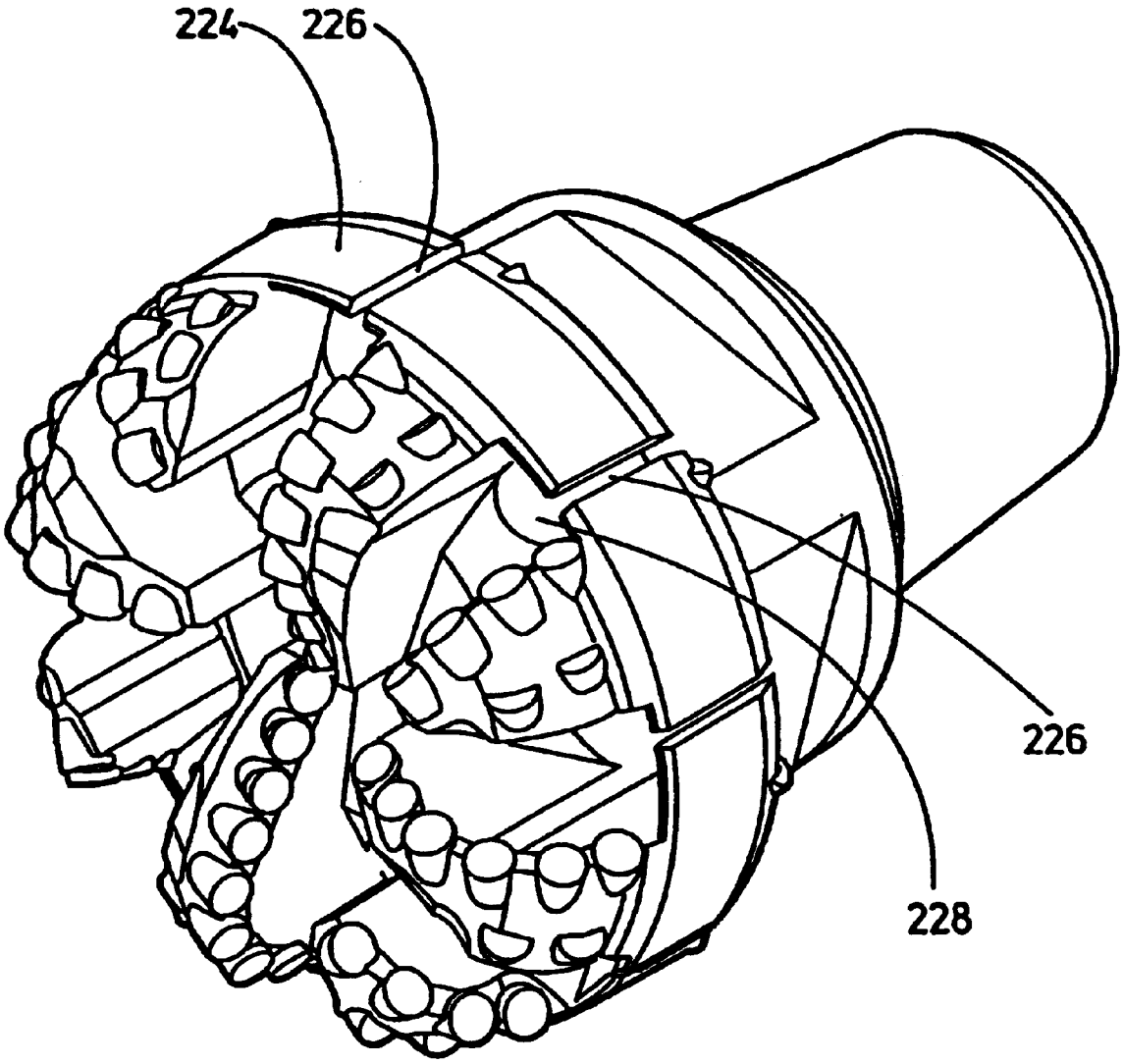

In a further modification, shown in FIG. 17, the gauge region 224 is formed around its periphery with a plurality of circumferentially spaced slots 226, each of which registers with one of the internal passages 228 passing through the bit body and passes completely through the thickness of the gauge so as to communicate with the passage 228. In use, drilling fluid flowing upwardly to the annulus through each internal passage 228 can leak through the slot 226 and onto the peripheral bearing surface of the gauge, so as to provide cooling, cleaning and lubrication of that bearing surface. The drill bit shown in FIG. 17 is otherwise generally similar to the bits described in relation to FIGS. 1–5 and may also include any of the features specifically described in relation to those figures.

Figure 18:
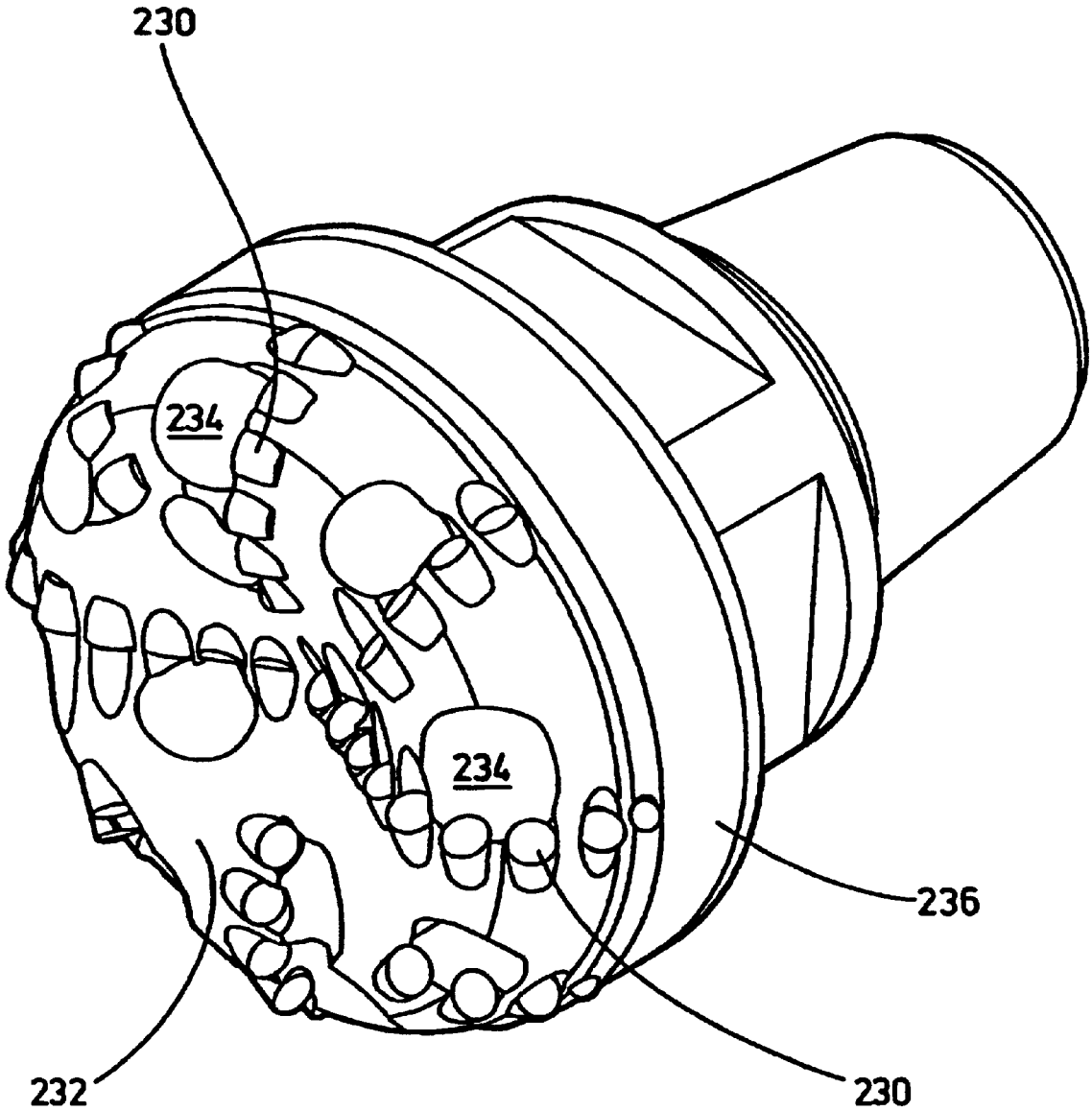

In all of the arrangements described in relation to FIGS. 1–5, the leading face of the bit body has included a plurality of blades extending outwardly away from the central axis of the drill bit so as to define outwardly extending channels between the blades, the cutting elements being mounted side-by-side along the blades and the internal passages in the drill bit extending from openings in the channels. However, FIG. 18 shows an arrangement in which cutting elements 230 are mounted directly on the leading face 232 of the bit body.

Openings 234 in the leading face lead into passages which extend internally through the bit body to outlets which communicate with the annulus between the drill string and the surrounding walls of the borehole, as previously described. The provision of such passages for the flow of drilling fluid allows the provision of a gauge bearing surface 236 which extends around the whole of the periphery of the drill bit. Nozzles (not shown) are provided in conventional manner to supply drilling fluid to the leading face of the drill bit for cooling and cleaning of the cutters. In FIG. 18, the cutting elements 230 are shown as being arranged side-by-side in rows which extend outwardly away from the center of the leading face of the drill bit. However, the cutters could be mounted randomly over the leading face of the drill bit.

Figure 5:
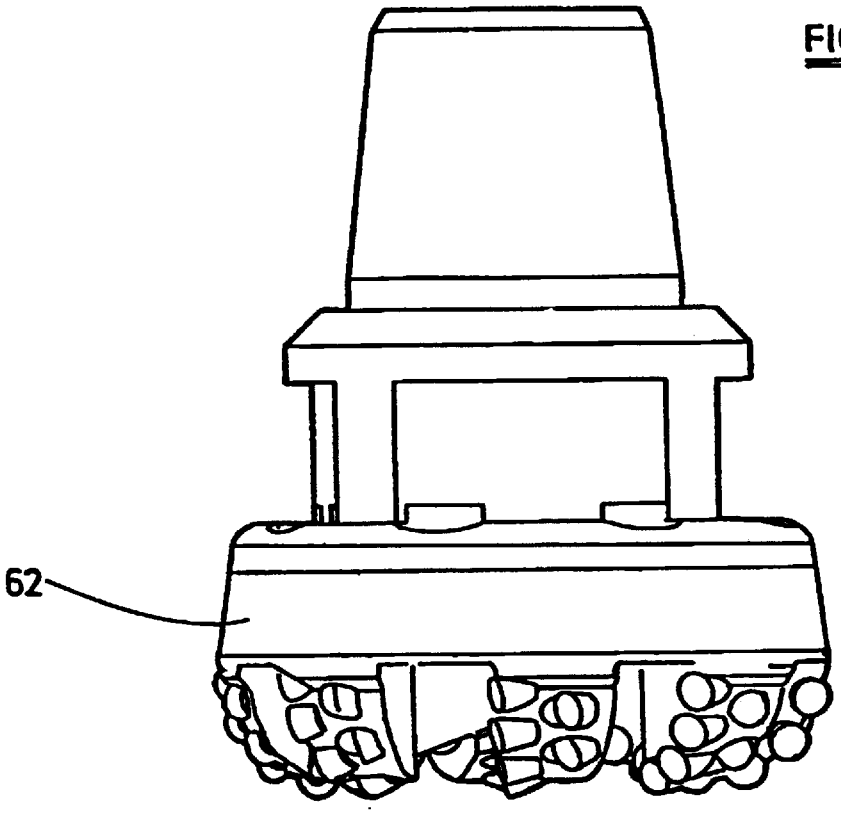
FIG. 5 is another similar view showing a tapered gauge region.
Figure 19:
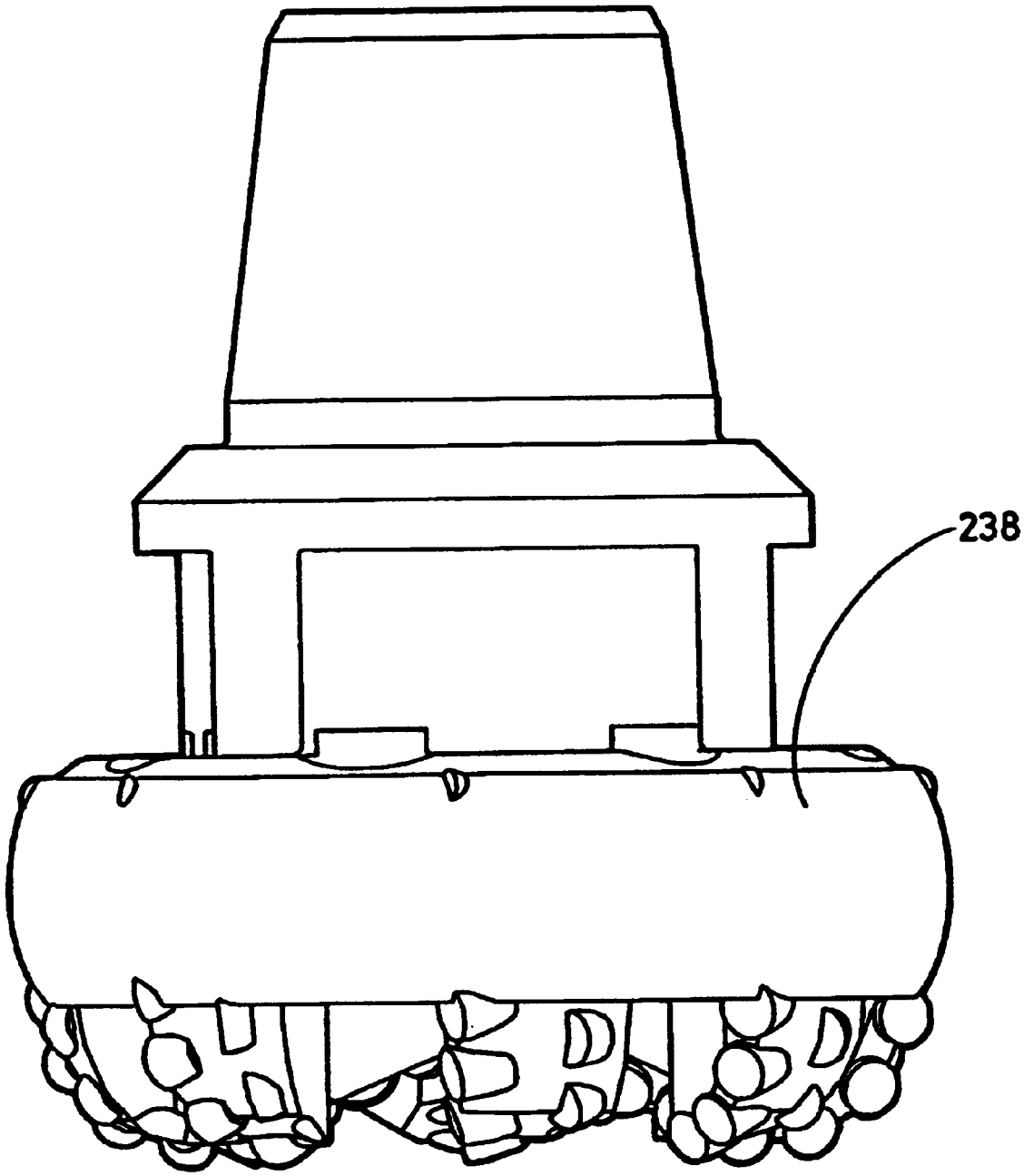
FIG. 19 is a side elevation of a still further form of drill bit.

FIG. 19 shows a modification of the arrangement described in relation to FIG. 5 where the outer peripheral surface 238 of the gauge region, instead of being frusto-conically tapered, is part circular in cross-section so as to be generally barrel-shaped. This arrangement facilitates tilting of the drill bit in the borehole thus enhancing the directional response of the drill bit when used in directional drilling.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A rotary drill bit for connection to a drill string and for drilling boreholes in subsurface formations comprising:

a bit body having a leading face and a gauge region;

a plurality of cutting elements mounted on the leading face of the bit body;

a plurality of fluid channels formed in the leading face of the bit body; and a plurality of nozzles mounted in the bit body for supplying drilling fluid to the channels for cleaning and cooling the cutting elements, wherein there is provided in at least one of said channels an opening into an enclosed passage which passes internally through the bit body to an outlet which, in use, communicates with the annulus between the drill string and the wall of the borehole being drilled, the gauge region of the drill bit comprising:

a bearing surface which extends around substantially the whole of the gauge region, said bearing surface tapering inwardly as it extends away from the leading face of the drill bit.

2. A drill bit according to claim 1, wherein the bearing surface of the gauge region is generally frusto-conical in shape.

3. A method of manufacturing a rotary drill bit of the kind comprising:

a bit body having a leading face and a gauge region;

a plurality of cutting elements mounted on the leading face of the bit body;

a plurality of fluid channels formed in the leading face of the bit body; and a plurality of nozzles mounted in the bit body for supplying drilling fluid to the channels for cleaning and cooling the cutting elements, wherein there is provided in at least one of said channels an opening into an enclosed passage which passes internally through the bit body to an outlet, the gauge region of the drill bit comprising:

a peripheral ring comprising a bearing surface which extends around substantially the whole of the gauge region, the peripheral ring further being provided with a plurality of enclosed passages which pass internally through the ring in the general direction of the axis thereof;

the method including the steps of forming a bit body structure and mounting on the outer periphery of the bit body structure the peripheral ring providing the gauge region of the drill bit.

4. A stabilizer for connection to a drill string comprising:

a stabilizer body which includes a substantially cylindrical portion having an outer peripheral bearing surface which extends around substantially the whole of the outer periphery of the cylindrical portion; and a plurality of enclosed passages which pass internally through the stabilizer body generally in the direction of the longitudinal axis of the stabilizer.

5. A stabilizer according to claim 4, wherein the stabilizer body is formed from a plurality of annular rings of the same diameter secured axially together, the rings being formed with registering ports spaced circumferentially apart, the combination of the registering ports on the stacked rings forming said enclosed passages within the stabilizer body.

6. A stabilizer according to claim 4, wherein said enclosed passages are formed in a one-piece hollow sleeve which is mounted on a central tubular mandrel having a central passage and means for connection to the drill string.

7. A rotary drill bit for connection to a drill string and for drilling boreholes in subsurface formations comprising:

a bit body having a leading face and a gauge region;

a plurality of blades mounted on the leading face of the bit body;

a plurality of cutting elements mounted along each blade;

a plurality of nozzles mounted in the bit body for supplying drilling fluid to the surface of the bit body for cleaning and cooling the cutting elements;

at least one opening disposed in said leading face, said opening leading to a passage passing internally through said bit body between said opening and an outlet; and a bearing surface disposed at a portion of said gauge region radially outwardly from said opening, which bearing surface is arcuate as viewed in cross-section in a plane containing the axis of rotation of the bit.

8. A rotary drill bit for drilling a borehole, said drill bit comprising:

a bit body having a leading face at least one channel formed in said leading face, and a substantially continuous bearing member, said bearing member being axially spaced from said leading face, an opening formed in said channel, said opening leading to a passage through said bearing member to an outlet.

* * * * *